United States Patent [19]

Miraldi

[11] Patent Number: 4,970,110

[45] Date of Patent: Nov. 13, 1990

[54] PROCESS FOR IMPROVING THE TEAR RESISTANCE OF HOSIERY

[76] Inventor: Carla Miraldi, 3116 Fairmount Blvd., Cleveland Heights, Ohio 44118

[21] Appl. No.: 330,211

[22] Filed: Mar. 29, 1989

[51] Int. Cl.[5] ..... B32B 7/00

[52] U.S. Cl. ..... 428/254; 422/253

[58] Field of Search ..... 428/253, 254

[56] References Cited

U.S. PATENT DOCUMENTS

| | | | |
|---|---|---|---|
| 2,308,593 | 1/1943 | Brew | 66/202 |
| 2,526,684 | 10/1950 | Powers et al. | 117/121 |
| 2,832,518 | 4/1958 | Doyle et al. | 223/76 |
| 2,962,384 | 11/1960 | Ljungbo | 117/38 |
| 4,192,862 | 3/1980 | Pengilly | 424/47 |
| 4,289,823 | 9/1981 | Arkens | 428/245 |
| 4,405,341 | 9/1983 | Jaschek et al. | 51/298 |
| 4,569,965 | 2/1986 | Engel et al. | 524/544 |
| 4,673,571 | 6/1987 | Mahieu et al. | 424/70 |

*Primary Examiner*—James J. Bell

*Attorney, Agent, or Firm*—Pearne, Gordon, McCoy & Granger

[57] ABSTRACT

This invention is directed to a process for improving the run and snag resistance of hosiery such as nylons by treating the hosiery with a composition comprising a polymeric synthetic resin having average molecular weights ranging up to 100,000 in combination with an amine neutralizing agent, an alcohol amide, organic solvents, water, and propellant.

17 Claims, No Drawings

PROCESS FOR IMPROVING THE TEAR RESISTANCE OF HOSIERY

BACKGROUND OF THE INVENTION

This invention relates to the process for improving the run and snag resistance of hosiery knitted from synthetic fibers and to a synthetic resin composition useful for rendering knitted fabric, e.g., nylon hosiery, resistant to runs or snags.

Heretofore, to render stockings resistant to runs, it was necessary to utilize an adhesive-type material which would form visible patterns and be seen as a blemish on the hosiery. Moreover, adhesives were applied by spraying the material, which formed a coating on the fabric which would reduce the elasticity to a fraction of what it was prior to the spray treatment. The disadvantage of treating knitted fabric, e.g., nylon hosiery, to render the hose resistant to runs by the use of adhesives is avoided by the present invention.

More specifically, this invention is directed to machine-made knitted fabrics, including knitted articles such as ladies' hosiery and the like. This invention is particularly concerned with fabric knitted from continuous filaments, including natural materials such as silk, or artificial filaments such as nylon and rayon. The term "filament" denotes an elongated knittable or continuous structure, as distinguished from spun yarn. The continuous filaments are characterized by having a uniform cross section and a smooth surface.

However, one of the problems with filamentary knitted materials of fine gauge is that the stitch is susceptible to laddering. For example, in ladies' hosiery, a loop stitch broken at the knee may cause a ladder along the length of the stocking. When hosiery are worn, they are susceptible to a certain amount of lateral tension which tends to weaken the loop stitches and thereby disengage successive stitches once a broken stitch occurs. The treatment of fine gauge knitted materials in accordance with this invention involves forming a film on the hosiery to prevent laddering and also to maintain a sufficient degree of elasticity to ensure a good fit without permanent distortion.

In accordance with this invention, fine or sheer knit goods are treated with a solution comprising a polymeric resin of various concentrations, depending on the means by which the solution of resin is applied to the fabric. For purposes of this invention, the polymeric resin is applied to the fabric in effective amounts sufficient to resist runs or snags, i.e., amounts ranging up to about 3% by weight of the fabric.

DETAILED DESCRIPTION OF THE INVENTION

The resins useful in preparing the hosiery treatment compositions of this invention are film-forming resins which, when applied to the hosiery, improve the run and snag resistance of the knitted fabric. The film-forming resins can be sprayed onto the hosiery by utilizing various types of dispensers. Most of the resin dispensers are aerosol containers from which the resin is discharged by a propellant. More recently, because of environmental requirements, the pump spray applicators, i.e., utilizing a mechanical pump, discharge the resin forming a protective film on the fabric. The resin composition of this invention comprises solutions of the polymeric resin in combination with amines, alcohol amides, solvents and water.

More specifically, this invention relates to a process for improving the tear resistance, i.e., the run and snag resistance, of hosiery knitted from synthetic fibers which comprises treating the hosiery with small but effective amounts, e.g., up to about 3% by weight of the fabric with a synthetic resin composition consisting essentially of (a) from about 0.5 to 15 parts by weight, preferably from about 1.0 to 10 parts by weight, of a polymeric synthetic resin having an average molecular weight ranging up to about 100,000, and preferably an average molecular weight ranging from about 20,000 to 60,000, (b) from about 0 to 2.0 parts by weight of at least one aliphatic amine neutralizing agent, and preferably from about 0.03 to 0.1 part by weight of the amine neutralizing agent, (c) from about 70 to 99 parts by weight of at least one organic solvent, e.g., lower alcohols for said synthetic resin, and preferably from about 75 to 90 parts by weight of said organic solvent, (d) from about 0 to 15 parts by weight of water, and preferably from about 2.0 to 10 parts by weight of water, (e) from about 0 to 1.0 part by weight of a cosmetic adjuvant, (f) from about 0.01 to 3.0, e.g., 0.01 to 0.3, parts by weight of an alcohol amide, and (g) from about 0 to 90 parts by weight, and preferably from about 25 to 50 parts by weight, of a propellant.

Where the resin composition is used in a container in combination with a propellant, the preferred propellants include the halogenated hydrocarbons, e.g., trichlorofluoromethane, dichlorodifluoromethane, and the like. Other useful propellants can be found on page 443 of Volume 2 of *Cosmetics, Science and Technology*, and in U.S. Pat. Nos. 3,026,250 and 3,145,147. Examples of compressed gas propellants include nitrogen and carbon dioxide. These propellants are used preferably in amounts ranging from about 10 to 75 parts by weight, and more likely in amounts ranging from about 25 to 50 parts by weight of the total composition. In addition, there are spray pump applicators for dispensing the synthetic resins. These are disclosed in the publication *Soap, Perfume and Cosmetics*, March 1977, pp. 89–93. There are also various mechanical pump devices described in *Modern Packaging* for October 1975, pp. 15 through 20.

The present invention also provides spray compositions which utilize aliphatic hydrocarbons as the propellant, e.g., propane or butane, etc., and combinations thereof, with up to 50 parts by weight of water. Water helps to reduce the flammability of the hydrocarbon propellants.

The preferred resin composition comprises copolymers of vinylalkyl ethers and a monoethyl or monobutyl ester of maleic acid or its anhydride, and from about 0.1 to 0.5 part by weight of an amine neutralizer for the free carboxyl groups of the copolymers.

Specifically, the copolymer of a monoalkyl ester of maleic acid and a vinylalkyl ether can be characterized by the formula:

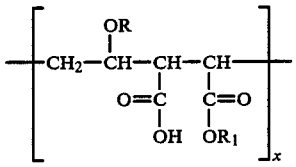

wherein R is an aliphatic radical having from 1 to 4 carbon atoms, $R_1$ is either an ethyl or butyl group, and x has the value sufficient to obtain polymers having average molecular weights ranging up to 100,000, e.g., from 20,000 to 60,000.

The preferred comonomers, i.e., vinylalkyl ethers, for purposes of this invention include methylvinyl ether and butylvinyl ether. These resins are prepared by conventional polymerization methods as set forth in German patent No. 571,665. These particular resins have average molecular weights ranging from about 20,000 to 60,000, with viscosities ranging from about 1.5 to 6 centipoise, i.e., a 5% solution in dimethyl formamide at 34° C. Commercially available resins include the copolymers of monoethyl ester of maleic acid and methylvinyl ether (Gantrez ES-225) and the copolymers of butyl monoester of maleic acid and vinylalkyl ether, commercially available as Gantrez ES-425.

Where the polymeric resins contain free carboxyl groups, the copolymer may be completely or partially neutralized by the addition of from about 0 to 2.0 parts by weight of a basic compound including amines such as dimethylamine, diethylamine, triethanolamine, 2-methyl-2 amino-1-propanol, etc. The addition, for example, of from about 0.1 to 0.5 part by weight of an amine neutralizing agent represents up to about 30% neutralization of the unreacted free carboxyl groups of the copolymer. These copolymers may be completely or partially neutralized with the amine to the degree of from about 10 to 75% of the free or unreacted carboxyl groups on the polymer.

Other synthetic resins useful for purposes of this invention include the polyvinylpyrrolidones and the copolymers of vinyl acetate and crotonic acid, as particularly disclosed in U.S. Pat. No. 2,996,471. Specific resins include terpolymers derived from vinyl acetate crotonic acid and a vinyl ester of aliphatic monocarboxylic acid having a minimum of 5 carbon atoms in the carboxyl moiety. These particular terpolymers are disclosed in U.S. Pat. No. 3,810,977, and are commercially available under the trade name "Resyn" terpolymer.

Of the various polymeric resins, the copolymers of methylvinyl ether and maleic anhydride in a ratio of about 1:1 are particularly preferred. These copolymers are esterified with aliphatic alcohols having 1 to 4 carbon atoms, and are neutralized, i.e., via acid groups, by using neutralizing agents such as the amines, and particularly the amino alcohols such as 2-amino, 2-methyl 1,3 propanediol and 2-amino, 2-methyl-1-propanol, etc. These and other neutralizing agents are known in the art, as set forth in U.S. Pat. No. 2,996,471.

Other useful terpolymers for purposes of this invention includes the polymers of vinyl acetate, crotonic acid, and a vinyl versatate. Similar copolymers include copolymers of vinylpyrrolidone with vinyl acetate and various acrylic polymers including polymers derived from the acryl amides, the acrylate, and the methacrylates which contain unreacted carboxyl groups.

The acrylic synthetic resins can be derived from the copolymerization of various monomers, particularly the lower alkyl acrylate and/or methacrylates, and especially the methyl, ethyl, propyl, isopropyl, hexyl or octylacrylates or methacrylates. The preferred copolymers comprise reoccuring units derived from acrylic or methacrylic acid or units derived from the lower alkylacrylates or methacrylates and allyl alcohols. These acrylic copolymers can be neutralized, e.g., up to 100%, with effective amounts of amine compounds such as the ethanolamines, propanolamines and various other amino alcohols, such as 2-amino, 2-methyl 1,3 propanediol, etc.

The liquid carriers or organic solvents used for the synthetic resins preferably include the lower molecular weight alcohols, such as ethanol, propanol, isopropanol, butanol, the alkoxy alcohols, and combinations thereof, alone or with water.

In addition to the synthetic polymeric resins, the amines, the solvents and propellant, the resin compositions of this invention may comprise small but effective amounts, e.g., up to 1 part by weight, of one or more ingredients known in the cosmetic art, including, for example, perfumes, conditioning agents, plasticizers, or the like.

In order to reduce the foaming characteristics of the resin composition and improve the solubility of the resin to prevent severe accumulation of the resin at the nozzle of an aerosol or pump dispenser, it was found necessary to incorporate in the composition from about 0.01 to 3.0 parts by weight of an alcohol amide compound, i.e., 2,4 dihydroxy-N-(3-hydroxypropyl) 3,3-dimethyl butyramide. While the alcohol amide is not critical to the composition for improving the tear resistance of hosiery, it is essential for use in aerosol and pump spray equipment to prevent severe accumulations and improve solubility of the resin at the nozzle. This particular alcohol amide was found to be unique in combination with the resins derived from copolymers of vinylalkyl ethers and the lower alkyl monoesters of maleic acid.

The following examples are illustrations for treating fabrics prepared from synthetic fibers such as nylon and rayon to improve the tensile strength, and thereby resist runs and snags.

EXAMPLE 1

| Components | Parts by Weight |
|---|---|
| Polymeric resin (Gantrez) | 0.5 to 15 |
| Pantothenol | 0.01 to 3.0 |
| Amine base neutralizing agent (2-amino, 2-methyl-1,3 propanediol (AMPD) | 0 to 2.0 |
| De-ionized water | 0 to 15 |
| Solvents, e.g., lower alcohols such as ethanol | 70 to 99 |

1. The resin is a 50% solution in alcohol of a copolymer of methylvinyl ether and maleic acid butyl ester available as Gantrez.
2. Pantothenol is 2,4 dihydroxy-N-(3-hydroxy propyl)-3,3-dimethyl butyramide.

EXAMPLE 2

| Components | Parts by Weight |
|---|---|
| Polymeric resin of Example 1 | 5.34 |
| Pantothenol | 0.01 |
| AMPD (amine base) | 0.03 |
| Solvent, e.g., alcohols | 94.50 |

EXAMPLE 3

| Components | Parts by Weight |
|---|---|
| Polymeric resin of Example 1 | 5.34 |
| Pantothenol | 0.01 |
| AMPD (amine base) | 0.1 |
| Solvent | 94.5 |

EXAMPLE 4

| Components | Parts by Weight |
|---|---|
| Polymeric resin of Example 1 | 5.34 |
| Pantothenol | 0.03 |
| AMPD (amine base) | 0.03 |
| Solvents | 94.5 |

EXAMPLE 5

| Components | Parts by Weight |
|---|---|
| Polymeric resin of Example 1 | 5.34 |
| Pantothenol | 0.03 |
| AMPD (amine base) | 0.1 |
| Solvents | 94.5 |

EXAMPLE 6

| Components | Parts by Weight |
|---|---|
| Polymeric resin of Example 1 | 5.34 |
| Pantothenol | 0.1 |
| AMPD (amine base) | 0.03 |
| Solvent | 94.5 |

EXAMPLE 7

| Components | Parts by Weight |
|---|---|
| Polymeric resin of Example 1 | 5.34 |
| Pantothenol | 0.1 |
| AMPD (amine base) | 0.1 |
| Solvent | 94.5 |

EXAMPLE 8

| Components | Parts by Weight |
|---|---|
| Polymeric resin of Example 1 | 5.34 |
| Pantothenol | 0.3 |
| AMPD (amine base) | 0.03 |
| Solvent | 94.5 |

EXAMPLE 9

| Components | Parts by Weight |
|---|---|
| Polymeric resin of Example 1 | 5.34 |
| Pantothenol | 0.3 |
| AMPD (amine base) | 0.1 |
| Solvent | 94.5 |

With an average of about 8 testers for each of the above Examples, hosiery treated in accordance with this invention showed that as the pantothenol (amide) and amine (AMPD) base were varied with respect to one another, the optimum ratio between the AMPD and pantothenol as illustrated in Example 8 resulted in an increase in average days of wear of 6.67 as compared to the other Examples, which resulted in an average of about 4+ days of wear. While the pantothenol and amine base can vary, e.g., from 0.01 to 0.3 part by weight of pantothenol with respect to 0.03 to 0.1 part by weight of the amine, it was found that as the pantothenol increased the average days of wear increased. As illustrated by the Examples, the various components of the synthetic composition may be varied within the ranges stated with respect to one another without adversely affecting the use of the composition for the purpose set forth in this application. The relative amounts of each of the components of the composition were found not to be as effective when the amine neutralizing agent was reduced to a ratio below 0.03 part by weight with respect to the pantothenol. Similarly, it was found that the most effective composition was obtained when utilizing pantothenol in an amount ranging from about 0.01 to 0.3 part by weight for 0.03 to 0.1 part by weight of the amine base.

Accordingly, while the ratios between the pantothenol, AMPD, and the synthetic resin may vary within the ranges as set forth herein, their optimum ratios with respect to the amount of AMPD and pantothenol used in combination with the synthetic resin will depend on the particular composition of the resin utilized, as described herein.

In accordance with this invention, the resin in combination with the amide and amine base used to treat the knitted fabrics imparts a greater coefficient of friction or slip resistance than is found in untreated fabrics, and this, in turn, improves the tensile strength and resistance to tears, runs, snags, and the like.

While this invention has been described with respect to a number of specific embodiments, it is obvious that other variations or modifications may be made without departing from the spirit and scope of the invention as set forth in the appended claims.

What is claimed is:

1. A process for improving the run and snag resistance of hosiery knitted from synthetic fibers which comprises treating the hosiery with an effective amount of a synthetic resin composition consisting essentially of from about (a) 0.5 to 15 parts by weight of a poylmeric synthetic resin having an average molecular weight ranging up to about 100,000;
(b) a neutralizing amount of an aliphatic amine;
(c) 70 to 99 parts by weight of at least one organic solvent for said resin;
(d) 0 to 15 parts by weight of water;
(e) 0 to 1.0 part by weight of a cosmetic adjuvant;
(f) 0.01 to 3.0 parts by weight of an alcohol amide; and
(g) 0 to 90 parts by weight of propellant.

2. The process of claim 1 further characterized in that the hosiery are knitted from nylon fiber, and the resin is a copolymer of a vinylalkyl ether and a lower alkyl monoester of maleic acid or anhydride.

3. The process of claim 1 further characterized in that the resin is a polymer of vinylpyrrolidone.

4. The process of claim 1 further characterized in that the resin is a terpolymer derived from an acrylamide, an acrylate, and a methacrylate.

5. The process of claim 1 further characterized in that the propellant is present in an amount ranging from about 25 to 50 parts by weight and consists of a mixture of propane and butane.

6. The process of claim 1 further characterized in that the resin has an average molecular weight ranging from about 20,000 to 60,000.

7. The process of claim 2 further characterized in that the amine neutralizing agent is 2-amino-2-methyl-1,3-propanediol.

8. The process of claim 1 further characterized in that the organic solvents are lower molecular weight alcohols comprising ethanol, propanol and mixtures thereof.

9. The process of claim 1 further characterized in that water is present in an amount ranging from about 2 to 10 parts by weight, and the solvent comprises at least one lower molecular weight aliphatic alcohol present in an amount ranging from about 75 to 90 parts by weight of the composition.

10. A process of improving the run and snag resistance of hosiery knitted from threads of synthetic fibers which comprises treating said hosiery with an effective amount of a liquid synthetic composition comprising from about (a) 1.0 to 10 parts by weight of a synthetic polymeric resin derived from maleic acid or anhydride and vinyl ether having an average molecular weight ranging from about 20,000 to 60,000;
(b) 0.03 to 0.1 part by weight of an aliphatic amine neutralizing agent;
(c) 2.0 to 10 parts by weight of water;
(d) 0 to 1.0 part by weight of a cosmetic adjuvant;
(e) 0.01 to 0.3 part by weight of pantothenol alcohol; and
(f) 70 to 99 parts by weight of at least one organic solvent for said polymeric resin.

11. The process of claim 10 further characterized in that a propellant is present in the composition in an amount ranging from about 25 to 50 parts by weight, said propellant selected from the group consisting of fluorinated hydrocarbons and low molecular weight hydrocarbons.

12. The process of claim 10 characterized in that the resin is present in an amount ranging from about 1.0 to 10 parts by weight, the amine neutralizer is present in an amount ranging from about 0.03 to 0.1 part by weight, the water is present in an amount ranging from 2 to 10 parts by weight, and the solvent is a mixture of ethanol and propanol present in an amount ranging from about 75 to 90 parts by weight.

13. The process of claim 10 further characterized in that the resin is a copolymer of a vinylalkyl ether and a lower alkyl ester of maleic acid or anhydride.

14. The process of claim 13 further characterized in that the amine neutralizer is an alkanolamine.

15. The process of claim 10 further characterized in that the solvent is a lower molecular weight alcohol having 1 to 4 alkyl carbon atoms.

16. The process of claim 14 further characterized in that the lower molecular weight alcohol is ethanol, propanol, or mixtures thereof.

17. A process of improving the run and snag resistance of nylon hosiery knitted from threads of synthetic fibers which comprises treating said hosiery with an effective amount of a liquid synthetic composition comprising from about 1.0 to 10 parts by weight of a copolymer of a vinylalkyl ether and a monoalkyl ester of maleic acid, from about 0.03 to 0.1 part by weight of 2-amino, 2-methyl, 1-propanol, from about 2 to 10 parts by weight of water, and from about 75 to 90 parts by weight of a mixture of ethanol and propanol.

* * * * *